US010891929B2

(12) United States Patent
Yamamoto

(10) Patent No.: US 10,891,929 B2
(45) Date of Patent: Jan. 12, 2021

(54) ACTUATOR, PRESSING DEVICE AND KEYBOARD INSTRUMENT

(71) Applicant: YAMAHA CORPORATION, Shizuoka (JP)

(72) Inventor: Shin Yamamoto, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/494,868

(22) PCT Filed: Mar. 15, 2018

(86) PCT No.: PCT/JP2018/010264
§ 371 (c)(1),
(2) Date: Sep. 17, 2019

(87) PCT Pub. No.: WO2018/173924
PCT Pub. Date: Sep. 27, 2018

(65) Prior Publication Data

US 2020/0043452 A1 Feb. 6, 2020

(30) Foreign Application Priority Data

Mar. 24, 2017 (JP) ..... 2017-060171

(51) Int. Cl.
*G10H 1/34* (2006.01)
*G10H 1/18* (2006.01)
(Continued)

(52) U.S. Cl.
CPC ..... *G10H 1/34* (2013.01); *G10B 3/12* (2013.01); *G10C 3/18* (2013.01); *G10H 1/18* (2013.01)

(58) Field of Classification Search
CPC ..... G10H 1/34; G10H 1/18; G10H 1/053; G10H 2220/285; G10H 1/346; G10C 3/18; G10C 3/12; G10B 3/12
See application file for complete search history.

(56) References Cited

U.S. PATENT DOCUMENTS

2015/0075317 A1* 3/2015 Donegan ..... B60T 7/06 74/512
2016/0284325 A1* 9/2016 Ohba ..... G10C 3/168

FOREIGN PATENT DOCUMENTS

JP 11-38976 A 2/1999
JP 11-175067 A 7/1999
(Continued)

OTHER PUBLICATIONS

International Search Report and Written Opinion of PCT Application No. PCT/JP2018/010264, dated May 29, 2018, 07 pages of ISRWO.

*Primary Examiner* — Jeffrey Donels
(74) *Attorney, Agent, or Firm* — Chip Law Group

(57) ABSTRACT

A relationship of $0<\alpha_1<2\theta_1$ is satisfied, where $\alpha_1$ is an angle formed between a first line which is vertical to a parallel line passing through a pivot center point and being parallel to a pivot extending direction, passes through a center point of a first portion from the center point of the first portion toward the parallel line, and a second line which is vertical, at the center point of the first portion, to a first portion extending direction, passes through the center point of the first portion toward a vertical line being vertical to the parallel line and passing through the pivot center point, and where $\theta_1$ is an angle formed between the first line and a third line connecting the pivot center point and the center point of the first portion from the center point of the first portion toward the pivot center point.

11 Claims, 13 Drawing Sheets

(51) Int. Cl.
*G10C 3/18* (2006.01)
*G10B 3/12* (2006.01)

(56) References Cited

FOREIGN PATENT DOCUMENTS

| | | | |
|---|---|---|---|
| JP | 2004-198721 | A | 7/2004 |
| JP | 2004-226687 | A | 8/2004 |
| JP | 2015-115224 | A | 6/2015 |

* cited by examiner

ACTUATOR, PRESSING DEVICE AND KEYBOARD INSTRUMENT

CROSS REFERENCE TO RELATED APPLICATIONS

This application is a U.S. National Phase of International Patent Application No. PCT/JP2018/010264 filed on Mar. 15, 2018, which claims priority benefit of Japanese Patent Application No. JP 2017-060171 filed in the Japan Patent Office on Mar. 24, 2017. Each of the above-referenced applications is hereby incorporated herein by reference in its entirety.

BACKGROUND

The present disclosure relates to an actuator, a pressing device and a keyboard instrument.

In an acoustic piano, a predetermined feeling, hereinafter called "touch feeling," is imparted to a finger of a player via a key through operation of an action mechanism. The acoustic piano, therefore, requires such action mechanisms to hit strings by hammers. In an electronic keyboard music instrument, on the other hand, key depressions are detected by sensors so that the generation of sounds is possible without including action mechanisms unlike the acoustic piano or the like. Touch feelings available from electronic keyboard music instruments, which use no action mechanisms, or electronic keyboard music instruments, which use simple action mechanisms, significantly differ from those available from acoustic pianos. To obtain as close touch feelings as possible to those available from acoustic pianos, techniques have hence been disclosed that arrange mechanisms corresponding to the hammers in the acoustic pianos, as disclosed in Japanese Patent Laid-Open No. 2004-226687, for example.

SUMMARY

According to such techniques, a hammer is actuated in cooperation with player's key pressing operation, whereby a sensor is pressed to generate a sound. Here, no problem arises if a force is always applied in a direction vertical to a key. In a case such that the key is located at a position distant from the player or the player strongly presses the key, however, a force is not always applied only in a vertical direction and may be applied off-center in a transverse direction to the key as seen from the player. Further, if a slight clearance or the like exists between a hammer and a member to which the hammer is secured, the hammer may move in a direction in which hammers are aligned, which direction may also be called "the scale direction," or the hammer may pivot in a plane, in which the hammer comes into contact with a sensor, with a fixed point of the hammer acting as a fulcrum. As a consequence, the sensor does not stably operate and may cause a failure in sound generation. Furthermore, if a key directly presses a sensor in a keyboard instrument in which hammers do not press sensors or no hammers are used, the above-described problem may also arise so that a failure in sound generation is prone to occur. Moreover, the above-described problem occurs not only at sensors in a keyboard instrument but also at members that do not have sensors but require a reaction force, that is, a repulsive force.

It is desirable to allow a player to stably generate reaction forces. It is further desirable to allow a player to stably generate sounds.

An actuator according to an embodiment of this disclosure includes a pivot, and a ridged surface on which an extending ridge part is formed and disposed. In a plan view of the ridged surface, the ridge part has a first portion configured to satisfy a relationship of $0<\alpha_1<2\theta_1$, where $\alpha_1$ is an angle formed between a first line which is vertical to a parallel line that passes through a center point of the pivot and that is parallel to a direction in which the pivot extends, the first line passing through a center point of the first portion, and a second line which is vertical, at the center point of the first portion, to a direction in which the first portion extends, the second line passing through the center point of the first portion, and $\theta_1$ is an angle formed between the first line and a third line which connects the center point of the pivot and the center point of the first portion.

In the above-described actuator, the angle $\alpha_1$ may be smaller than 90°.

In the above-described actuator, the ridge part further has a second portion, and the second portion is configured to satisfy a relationship of $\alpha_1<\alpha_2$, where $\alpha_2$ is an angle formed between a fourth line which is vertical to the parallel line, the fourth line passing through a center point of the second portion and extending from the center point of the second portion toward the parallel line, and a fifth line which is vertical to a direction in which the second portion extends, the fifth line passing through the center point of the second portion and extending toward the parallel line or the vertical line.

In the above-described actuator, the ridge part may be disposed in an arc shape with respect to the center point of the pivot.

In the above-described actuator, at least one additional ridge part is formed on the ridged surface so that a plurality of ridge parts is arranged on the ridged surface, a first ridge part, which is one of the ridge parts, is disposed closer to the pivot than a second ridge part, which is a remaining one ridge part, and the first ridge part has a radius of curvature smaller than that of the second ridge part.

An actuator includes a pivot center and a ridged surface on which at least one ridge part having an arc-shaped portion is formed.

In the above-described actuator, the arc-shaped portion has a center disposed at the same location as the pivot center.

A pressing device according to another aspect of this disclosure includes the above-described actuator and a movable member to be pressed by the actuator. An elastic material is used in the movable member.

The pressing device may be a reaction-force generating device.

The pressing device may be a switching device.

A keyboard instrument according to a further aspect of this disclosure includes the above-described pressing device, in which the actuator includes a hammer.

A keyboard instrument according to a still further aspect of this disclosure includes the above-described pressing device, in which the actuator includes a key.

A keyboard instrument according to an even further aspect of this disclosure includes the above-described pressing device, in which the actuator includes an interlock member that is interlocked with a key or a hammer.

According to this disclosure, a player can stably generate reaction forces. According to this disclosure, the player can also stably generate sounds.

DETAILED DESCRIPTION OF THE PREFERRED EMBODIMENTS

Figure 1:
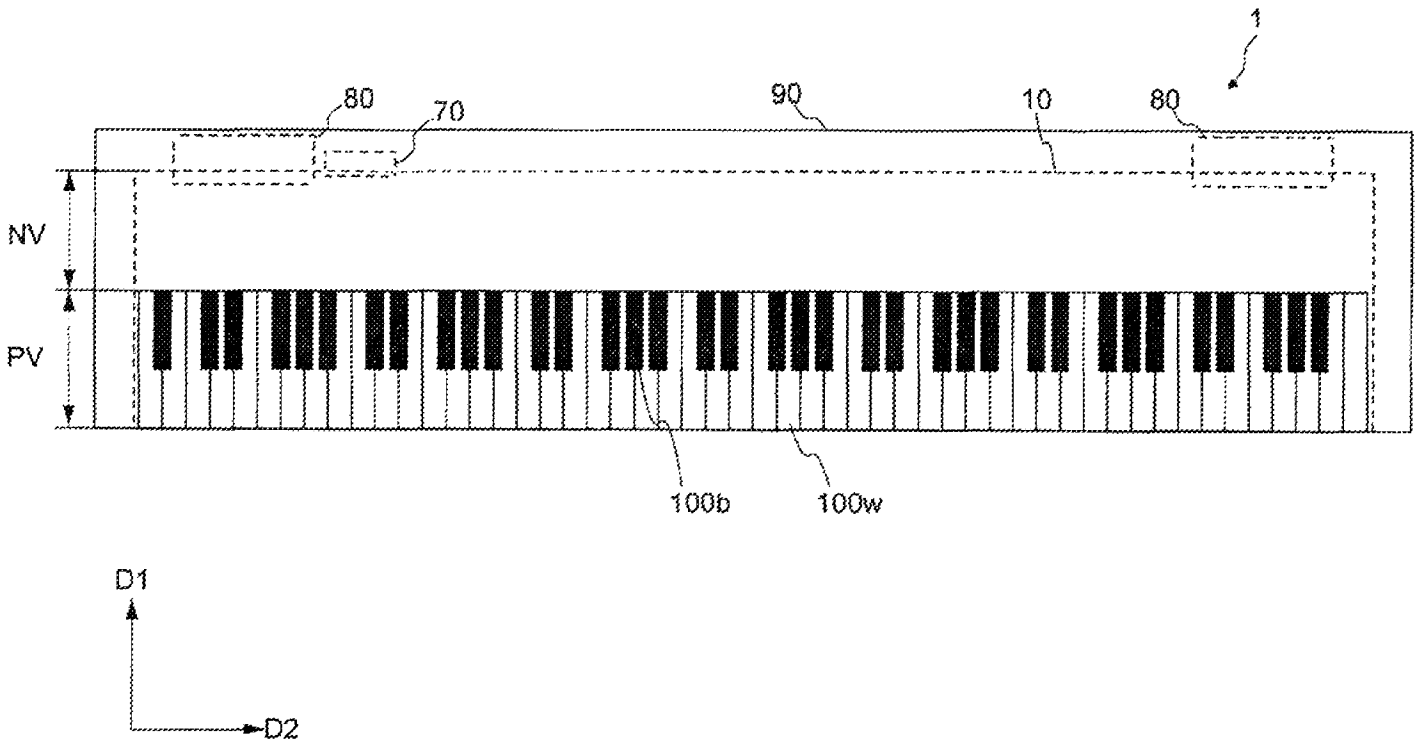
FIG. 1 is a view illustrating a configuration of a keyboard instrument in a first embodiment of this disclosure.

With reference to the drawings, a description will hereinafter be made in detail about keyboard instruments in first and second embodiments of this disclosure. The following embodiments are merely examples of embodiments of this disclosure so that this disclosure should not be construed as being limited to these embodiments. In the drawings to be referred to in the descriptions of the embodiments, the same or similar reference signs, which may include numerals followed by a character, such as A or B, are applied to the same parts or parts having similar functions and their repeated descriptions may be omitted. For the convenience of description, dimensional ratios in each drawing, such as ratios between individual elements or their ratios in length, width and height directions, may be different from actual ratios, and portions or parts of elements may be omitted from the drawings.

First Embodiment 1-1. Configuration of Keyboard Instrument

FIG. 1 is a view illustrating a configuration of a keyboard instrument in this embodiment. In this example, a keyboard instrument 1 is an electronic keyboard music instrument, such as an electronic piano, that generates sounds according to key depressions by a user or player. The keyboard instrument 1 may be a keyboard-type controller that according to key depressions, outputs control data such as musical instrument digital interface (MIDI) data, for the control of an external sound source device. In this case, the keyboard instrument 1 may be provided with no sound source device.

The keyboard instrument 1 is provided with a keyboard assembly 10. The keyboard assembly 10 includes white keys 100*w* and black keys 100*b*. The white keys 100*w* and black keys 100*b* are aligned side by side. The number of these keys 100 is N, which is 88 in this example. The direction in which the keys 100 are aligned is called "the scale direction." The white keys 100*w* and black keys 100*b* may be referred to as "the keys 100" if they can be described without specifically distinguishing them. In the description that follows, the addition of a suffix "w" to a reference sign also means an element corresponding to a white key. Likewise, the addition of a suffix "b" to a reference sign also means an element corresponding to a black key.

The keyboard assembly 10 partly exists inside a housing 90. In a case where the keyboard instrument 1 is viewed from above, a part of the keyboard assembly 10, the part being covered by the housing 90, is called a "non-visible part NV," while the remaining part which is exposed from the housing 90 and is visible from the user is called a "visible part PV." In other words, the visible part PV corresponds to parts of the keys 100, and indicates key areas that can be operated by the user to perform a music piece. The parts of the keys 100, which are exposed at the visible part PV, may hereinafter be called "main key parts."

Inside the housing 90, a sound source device 70 and a speaker 80 are disposed. The sound source device 70 generates audio waveform signals responsive to depressions of the keys 100. The speaker 80 outputs the audio waveform signals, which have been generated at the sound source device 70, to an external space. The keyboard device 1 may be provided with a slider for controlling the volume, a switch for changing the timbre, a display for displaying various information, and the like.

It is to be noted that in this Description, directions such as "up," "down," "left," "right," "front" and "back" indicate directions in a case where the keyboard instrument 1 is viewed from the player during performance. Therefore, the non-visible part NV, for example, can be expressed as being located on a back side of the visible part PV. Like key-front-end side or key-front side, and key-back-end side or key-back side, directions may also be indicated relative to the key 100 as a reference. In this case, a key-front-end side indicates a front side relative to the key 100 as viewed from the player. A key-back-end side indicates a back side relative to the key 100 as viewed from the player. According to this definition, parts of the black keys 100*b*, the parts extending from front ends to rear ends of the main key parts of the black keys 100*b*, can be expressed as parts protruding upward beyond the white keys 100*w*. A direction D1 in FIG. 1 is a direction from the front side to the back side, and can be called "a front-and-back direction D1." On the other hand, a direction D2 is a direction in which the keys 100 are aligned, that is, the scale direction, and can be called "a horizontal direction D2" in FIG. 1.

Figure 2:
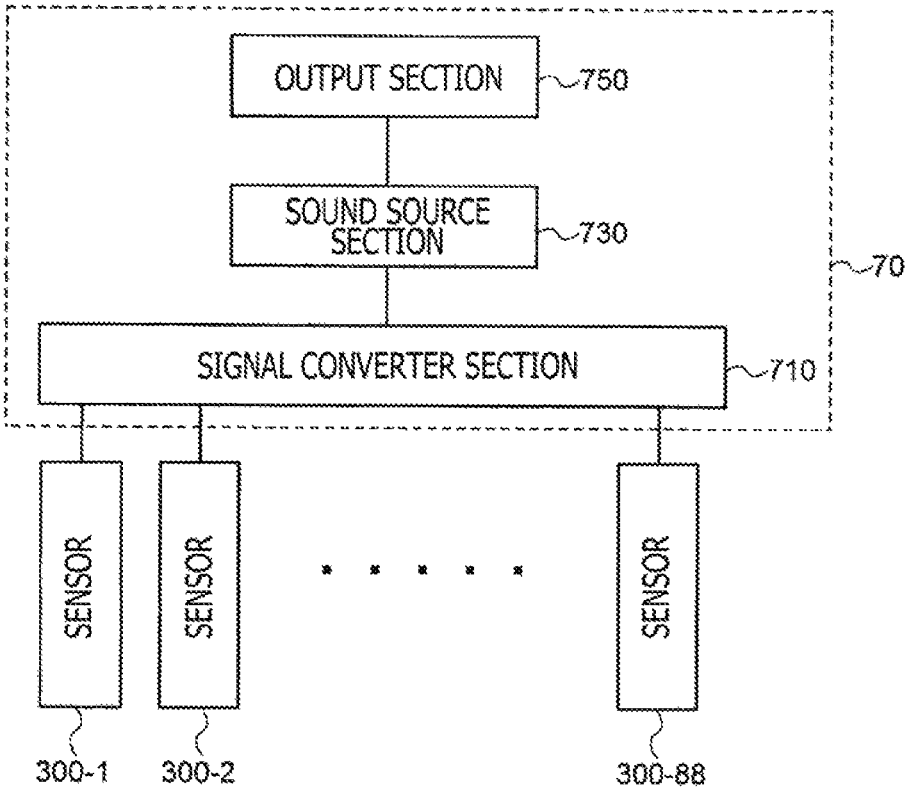
FIG. 2 is a block diagram illustrating a configuration of a sound source device in the first embodiment of this disclosure.

FIG. 2 is a block diagram illustrating a configuration of a sound source device 70 in this embodiment. The sound source device 70 is provided with a signal converter section 710, a sound source section 730 and an output section 750. Sensors 300 are arranged corresponding to the respective keys 100, detect key operations, and output signals according to the details detected. In this example, the sensors 300 each output signals corresponding to 3-stage key depression strokes. A key depression speed can be detected based on the intervals of the signals.

The signal converter section 710 acquires output signals from the sensors 300 including sensors 300-1, 300-2, . . . , 300-88 corresponding to the eighty-eight keys 100, and generates and outputs operation signals corresponding to the states of operations at the individual keys 100. In this example, the operation signals are signals in MIDI format. Therefore, the signal converter section 710 outputs a note on according to a key depression operation. At this time, a key number, which indicates which one of the eighty-eight keys 100 has been operated, and a velocity, which corresponds to a key depression speed, are also outputted in association with the note on. Responsive to a key release operation, on the other hand, the signal converter section 710 outputs a key number and a note off in association with each other. Signals according to other operations such as pedaling may also be inputted in the signal converter section 710 and may be reflected to operation signals.

The sound source section 730 generates audio waveform signals based on operation signals outputted from the signal converter section 710. The output section 750 outputs the audio waveform signals generated by the sound source section 730. These audio waveform signals are outputted, for example, to the speaker 80, an audio waveform signal output terminal, or the like. About a configuration of the keyboard assembly 10, a description will be made hereinafter.

1-2. Configuration of Keyboard Assembly

Figure 3:
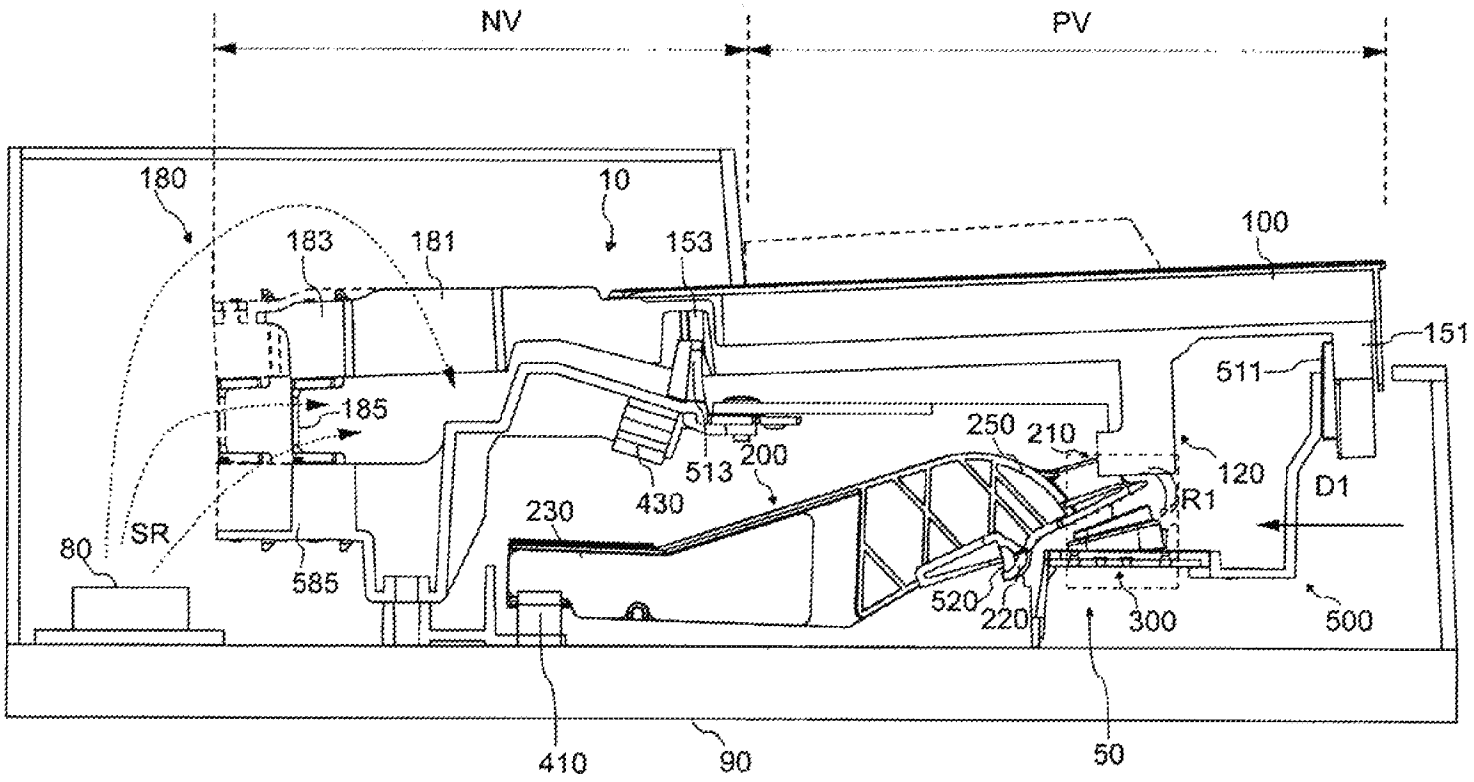
FIG. 3 is an explanatory view of a configuration of the inside of a housing in the first embodiment of this disclosure as viewed from a side wall of the keyboard instrument.

FIG. 3 is an explanatory view of a configuration of the inside of the housing in this embodiment as viewed in a direction from a side wall of the keyboard. As illustrated in FIG. 3, the keyboard assembly 10 and speaker 80 are disposed inside the housing 90. In other words, the housing 90 covers at least parts of the keyboard assembly 10, that is, connecting portions 180 and a frame 500, and the speaker 80. The speaker 80 is disposed on a back side of the keyboard assembly 10. This speaker 80 is disposed so that sounds according to key depressions are outputted upward and downward in the housing 90. The sounds outputted downward travel to the outside from a side of a lower wall of the housing 90. On the other hand, the sounds outputted upward pass from the inside of the housing 90, through a space inside the keyboard assembly 10, and travel to the outside from clearances between the adjacent ones of the keys 100 and clearances between the keys 100 and the housing 90. Routes of sounds from the speaker 80, the sounds reaching the space inside the keyboard assembly 10, specifically a space on a lower side of the keys 100 or main key parts, are exemplified as routes SR.

The keyboard assembly 10 includes, in addition to the above-mentioned keys 100, the connecting portions 180, hammer assemblies 200, and a frame 500. The keyboard assembly 10 is a resin-made structural body having a configuration most of which has been produced by injection molding or the like. The frame 500 is fixed on the housing 90. Each connecting portion 180 connects the corresponding key 100 pivotally to the frame 500. The connecting portion 180 is provided with a plate-shaped flexible member 181, a key-side supporting portion 183, and a channel-bar-shaped flexible member 185. The plate-shaped flexible member 181 extends from a back end of the key 100. The key-side supporting portion 183 extends from a back end of the plate-shaped flexible member 181. The channel-bar-shaped flexible member 185 is supported by the key-side supporting portion 183 and a frame-side supporting portion 585 of the frame 500. In other words, the channel-bar-shaped flexible member 185 is disposed between the key 100 and the frame 500. Through bending of the channel-bar-shaped flexible member 185, the key 100 can pivot relative to the frame 500. The channel-bar-shaped flexible member 185 is configured to be detachable from the key-side supporting portion 183 and frame-side supporting portion 585. The channel-bar-shaped flexible member 185 may also have a non-detachable configuration by its integration or adhesion or the like with the key-side supporting portion 183 and frame-side supporting portion 585.

Each key 100 is provided with a front-end key guide 151 and a side-wall key guide 153. The front-end key guide 151 is slidably in contact with a front-end frame guide 511 of the frame 500 with the front-end frame guide 511 being covered by the front-end key guide 151. At both sides of upper part and lower part of the front-end key guide 151 in the scale direction, the front-end key guide 151 is in contact with the front-end frame guide 511. At both sides of the side-wall key guide 153 in the scale direction, the side-wall key guide 153 is slidably in contact with a side-wall frame guide 513. In this example, the side-wall key guide 153 is disposed opposite to areas of the side walls of the key 100, the areas corresponding to the non-visible part NV, and exists on the key-front-end side of the connecting portion 180 or plate-shaped flexible member 181. However, the side-wall key guide 153 may also be disposed opposite to areas of the side walls of the key 100, the areas corresponding to the visible part PV.

Further, to each key 100, a key-side loading part 120 is connected underneath the visible part PV. The key-side loading part 120 is connected to the hammer assembly 200 so that, when the key 100 pivots, the hammer assembly 200 is pivoted.

The hammer assembly 200 is disposed in a space on a lower side of the key 100, and is pivotally secured to the frame 500. The hammer assembly 200 is provided with a weight portion 230 and a main hammer part 250. On the main hammer part 250, a pivot supporting portion 220 is disposed as a bearing for a pivot 520 of the frame 500. The pivot supporting portion 220 and the pivot 520 of the frame 500 are in slidable contact with each other at least three points. The pivot 520 is a shaft projecting from the frame 500 in a direction in which the keys 100 are aligned, that is, in the direction D2 indicated in FIG. 1. The central axis of the pivot 520, therefore, acts as a central axis, that is, an axis as a center of pivotal motion of the main hammer part 250 when the main hammer part 250 pivots about the pivot 520 while being kept in contact with the pivot 520 at the pivot supporting portion 220.

A hammer-side loading part 210 is connected to a front end portion of the main hammer part 250. The hammer-side loading part 210 is provided with a portion, where the hammer-side loading part 210 slidably comes into contact with the key-side loading part 120 substantially in the front-and-rear direction inside the key-side loading part 120. A lubricant such as grease may be applied to this contacting portion. The hammer-side loading part 210 and key-side loading part 120, which may also be referred to together as "the load generating part" in the following description, slide on each other to generate a portion of a load upon key depression. In this example, the load generating part is located underneath the corresponding key 100, on a front side of the back end of the corresponding main key part, in the visible part PV.

The weight portion 230 includes a metal-made weight, and is connected to a back end portion of the main hammer part 250, that is, on a back side of the pivot 520. During normal time or while the key is not depressed, the weight portion 230 is in a state of being placed on a lower stopper 410, whereby the key 100 remains stable at a rest position. When the key is depressed, the weight portion 230 moves upward, and hits an upper stopper 430. As a consequence, an end position as a maximum key depression stroke of the key 100 is defined. By the weight portion 230, a load is also applied to each key depression. The lower stopper 410 and upper stopper 430 are formed with a cushion material such as a non-woven fabric, or an elastic material.

Underneath the load generating part, the corresponding sensor 300 is secured to the frame 500. When the hammer-side loading part 210 is pivoted about the pivot 520 by a key depression and the sensor 300 is pressed and deformed, the sensor 300 outputs a detection signal. Accordingly, the hammer-side loading part 210, key-side loading part 120 and sensor 300 may also be referred to together as "a pressing device 50." As will be described subsequently herein, the pressing device 50 may also be called "a switching device" in a case where a switching operation is performed with electrodes as in the case of the sensor 300. The pressing device 50 is not limited to this configuration. About the configuration of the pressing device 50, a description will hereinafter be made in detail.

1-3. Configuration of Pressing Device

Figure 4:
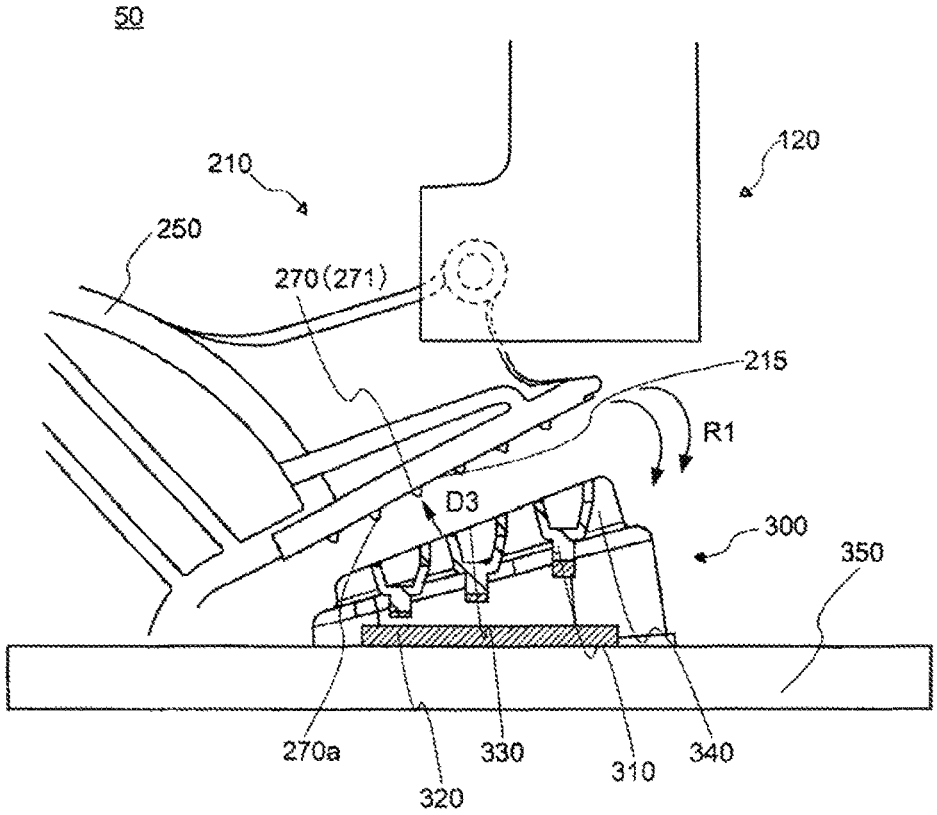
FIG. 4 is an explanatory view of a pressing device in the first embodiment of this disclosure as viewed from the side wall of the keyboard instrument.
Figure 5:
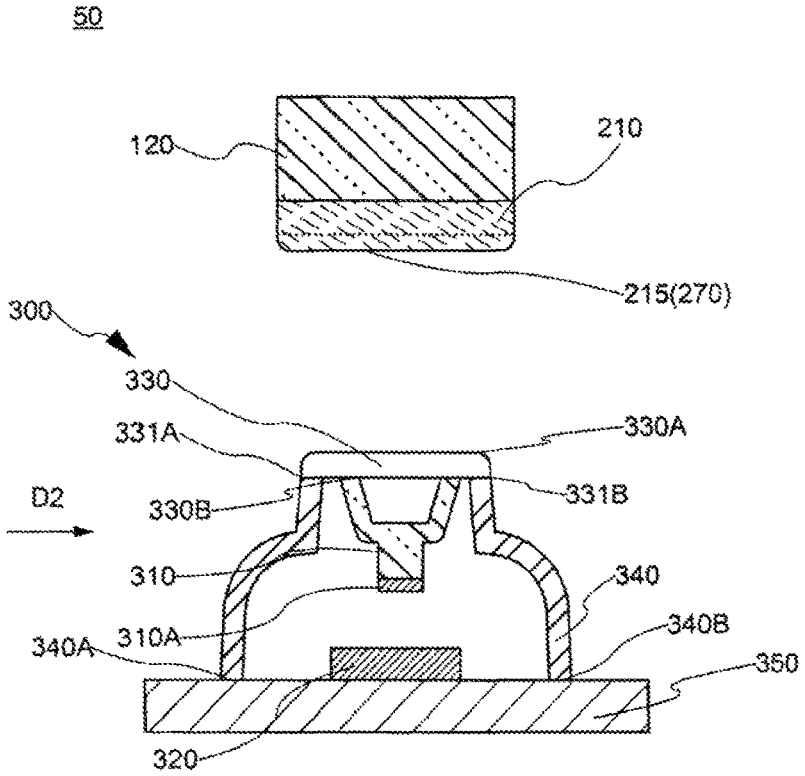
FIG. 5 is an explanatory view of the pressing device in the first embodiment of this disclosure as viewed from a front end side of a key.

FIG. 4 is an enlarged, cross-sectional view of the pressing device 50 extracted from FIG. 3. FIG. 5 is a cross-sectional view of the pressing device 50 as viewed from a front end side of the key 100, that is, in the direction D1.

The hammer-side loading part 210 has ridge parts 270, and a ridged surface 215 on which the ridge parts 270 are formed. Each ridge part 270 is disposed extending on the ridged surface 215. The ridge parts 270 may be rounded at tip portions 270*a* thereof.

The sensor 300 is provided with upper electrodes 310, a lower electrode 320, an upper-electrode supporting portion 330, deformable portions 340, and a lower-electrode supporting portion 350.

The upper electrodes 310 are arranged on a lower surface 330B of the upper-electrode supporting portion 330. The upper electrodes 310 are formed with an elastic material, and are provided at tip portions 310A thereof with conductive portions. In this example, molded silicone rubber parts are used as the upper electrodes 310, and conductive carbon black is used as a conductive material in the tip portions 310A.

The lower electrode 320 is disposed on a side of an upper surface of the lower-electrode supporting portion 350 so that the lower electrode 320 faces the upper electrodes 310. The lower electrode 320 includes a conductive material. For example, a metal material such as gold, silver, copper or platinum, or a conductive resin containing conductive carbon black is used for the lower electrode 320.

The deformable portions 340 are disposed to connect the upper-electrode supporting portion 330 and the lower-electrode supporting portion 350 together. Further, the deformable portions 340 may be fixed on the upper-electrode supporting portion 330 and the lower-electrode supporting portion 350 either directly or indirectly. In this example, the deformable portions 340 are fixed at connected portions 331A and connected portions 331B on the upper-electrode supporting portion 330, and at connected portions 340A and connected portions 340B on the lower-electrode supporting portion 350. In a case where the deformable portions 340 are fixed on another or other members, the deformable portions 340 may be unfixed on the lower-electrode supporting portion 350. The deformable portions 340 have a deformable function so that the upper electrodes 310 and the upper-electrode supporting portion 330 are movable in the up-and-down direction and the upper electrodes 310 and the lower electrode 320 can have a variable distance between them and may return to the original positions. Hence, a deformable and restorable material is used for the deformable portions 340. For example, molded silicone rubber components are used as the deformable portions 340.

The upper-electrode supporting portion 330 is disposed opposite the ridged surface 215 of the hammer-side loading part 210. In FIG. 5, the upper-electrode supporting portion 330 has a flat area on an upper surface 330A thereof. The upper surface 330A may have recesses in conformity to the shapes of the upper electrodes 310. The upper electrodes 310, upper-electrode supporting portion 330 and deformable portions 340 may be referred to together as "a movable member." For the movable member, an elastic material is used. For example, a soft material such as silicone rubber is used for the upper-electrode supporting portion 330 to enable its integral molding with the upper electrodes 310 and deformable portions 340. The material for the upper-electrode supporting portion 330, upper electrodes 310 or deformable portions 340 is not limited to a soft material and a coil spring or the like may also be used. In a case where combined into the movable member, the upper-electrode supporting portion 330 may also be called "an upper surface portion of the movable member." Further, the upper-electrode supporting portion 330 may be applied with a lubricant. As illustrated in FIG. 3, the upper-electrode supporting portion 330 is disposed aslant relative to the lower-electrode supporting portion 350 in conformity to a track R1 on which the hammer-side loading part 210 pivots. The upper-electrode supporting part 330 may have a configuration corresponding to a location where it is disposed, and may not disposed aslant.

The lower-electrode supporting portion 350 may be arranged as another member together with the lower electrode 320. For example, the lower-electrode supporting portion 350 may be arranged as a printed substrate, and the lower electrode 320 may be included as an electrode formed on the printed substrate. In this case, the lower-electrode supporting portion 350 may also be called "a substrate member." Therefore, the lower electrode 320 and the lower-electrode supporting portion 350 may be referred to together as "a circuit substrate."

1-4. Configuration of Ridge Parts

Figure 6:
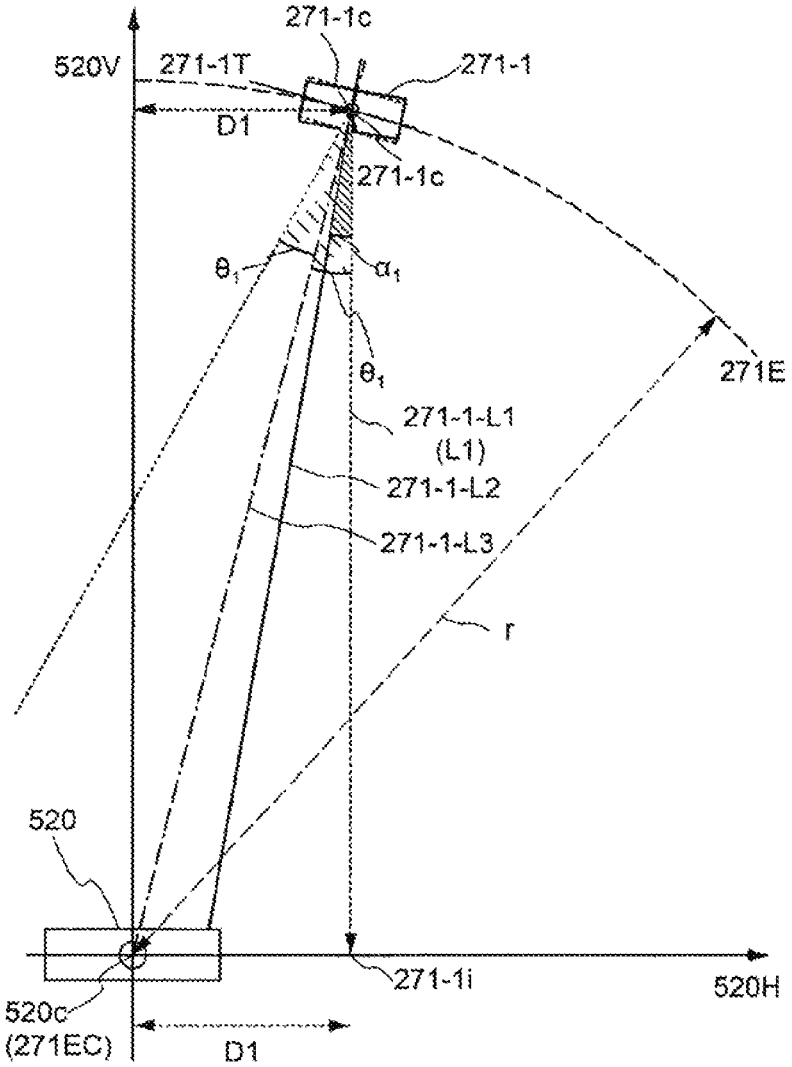
FIG. 6 is an explanatory view of a portion of a ridge part in a hammer-side loading part in the first embodiment of this disclosure as viewed from a lower surface of the key.
Figure 7A:
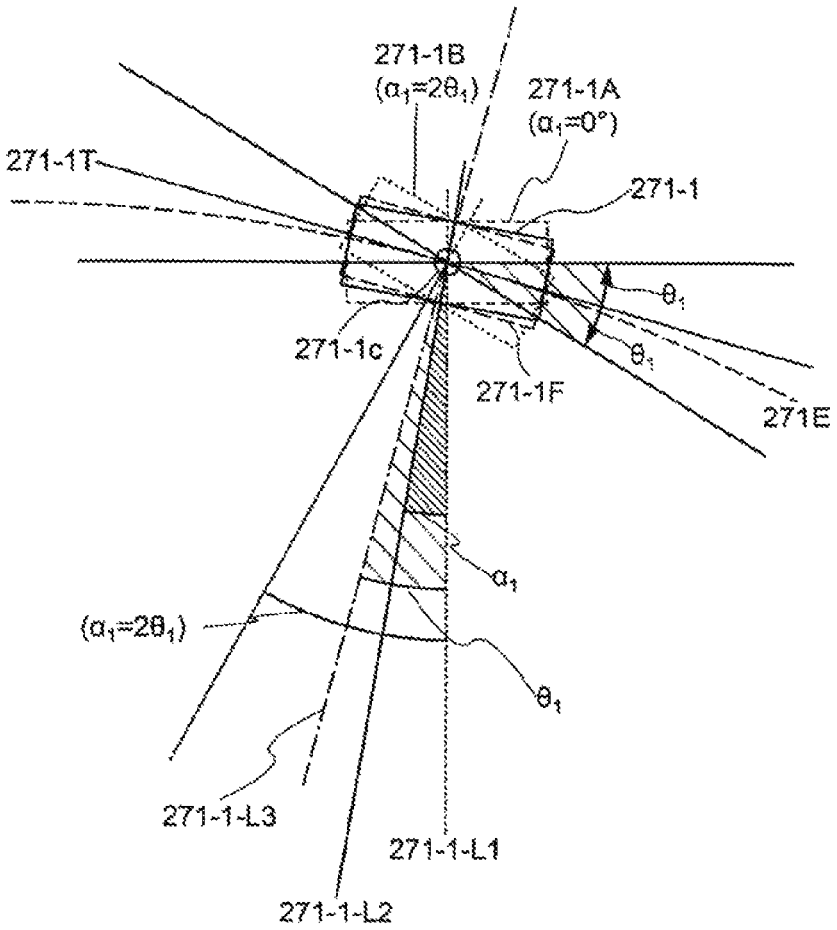
FIGS. 7A and 7B are explanatory views of the portion of the ridge part in the hammer-side loading part in the first embodiment of this disclosure as viewed from the lower surface of the key.
Figure 7B:
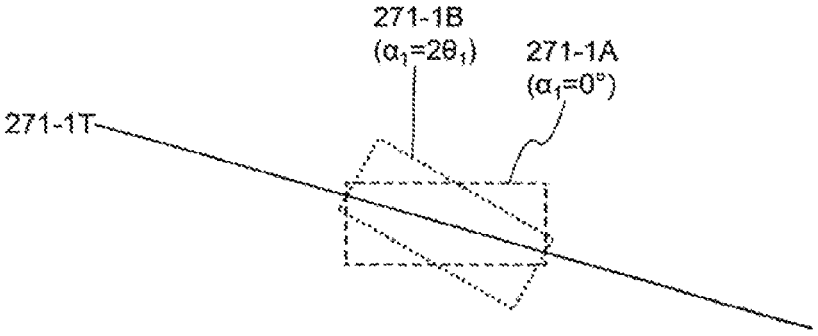

A description will next be made of a ridge part 271, which is one of the ridge parts 270. FIG. 6 is a schematic diagram illustrating a relationship between a portion 271-1, as an example of a first portion, which is a portion of the ridge part 271, and the pivot 520 in a plan view of the ridged surface 215 as viewed from a side of the upper-electrode supporting portion 330, that is, in a direction D3 of FIG. 4, in a plan view of the ridged surface 215. FIGS. 7A and 7B are enlarged diagrams of a center point 271-1*c* of the portion 271-1 and its vicinity. FIGS. 6, 7A, 7B, 8, 14 and 17 are schematic diagrams for describing layout relations between the ridge part or parts 270 and the pivot 520 by using the ridged surface 215 as a projection surface and projecting the ridge part or parts 270 and pivot 520 in the direction D3 on the ridged surface 215 when the ridged surface 215 is viewed in plan in the direction D3. The direction D3 is vertical to the ridged surface 215.

First, as illustrated in FIG. 6, there are a line 520H, as an example of a parallel line, and a line 520V, as an example of a vertical line. The line 520H indicates a line that extends from the pivot 520 projected on the ridged surface 215, passes through the center point 520*c* of the pivot 520 and is parallel to a direction in which the pivot 520 extends. On the other hand, the line 520V indicates a line that is vertical to the direction, in which the pivot 520 extends, and passes through the center point 520*c* of the pivot 520. There are also a center 271EC and an arc 271E. The center 271EC indicates a center point disposed at the same location as the center point 520*c* of the pivot 520, while the arc 271E indicates an arc that has a radius r and passes through the center point 271-1*c* of the portion 271-1. Now, there are three lines having the center point 271-1*c* as a start point, that is, a line 271-1-L1, a line 271-1-L2 and a line 271-1-L3. The line 271-1-L1 indicates the line that is vertical to the line 520H, passes through the center point 271-1*c*, and extends toward the line 520H. The line 271-1-L2 indicates the line that is vertical to an extending direction of the portion 271-1, passes through the center point 271-1*c*, and extends toward the line 520H or the line 520V. The line 271-1-L3 is the line that connects the center point 520*c* of the pivot 520 and the center point 271-1*c* of the portion 271-1 together and extends from the center point 271-1*c* to the center point 520*c*. In this example, the line 271-1-L3 has a length that is equal to the radius r. Further, the center point 520*c* of the pivot 520 is a center position of the pivot 520 in the direction in which the pivot 520 extends or in a longitudinal direction of the pivot 520, and is a center position on a cross-section vertical to the direction in which the pivot 520 extends at the center position. Furthermore, the center point 271-1*c* of the portion 271-1 is a center position of the portion 271-1 in the direction in which the portion 271-1 extends, and is a center position on a cross-section vertical to the direction in which the portion 271-1 extends at the center position.

The line 271-1-L1 and the line 271-1-L2 form an angle $\alpha_1$. On the other hand, the line 271-1-L1 and the line 271-1-L3 form an angle $\theta_1$. Now, the line 271-1-L1 is assumed to have a length L1. Further, the line from the line 520V to the center point 271-1*c* of the portion 271-1 is assumed to have a length D1. Here, there is the following relationship among the angle $\theta_1$, the length D1 and the length L1.

$$\tan \theta_1 = D1/L1$$

In the foregoing, the angle $\alpha_1$ and the angle $\theta_1$ have a relationship of $0<\alpha_1<2\theta_1$. Now, a portion that has the same center point 271-1*c* as the portion 271-1 in the ridge part 271 and is disposed along the arc 271E in the extending direction thereof is indicated as a portion 271-1F. At this time, as illustrated in FIG. 7A, the portion 271-1 is considered to be the portion 271-1F as having tilted upward or counterclockwise in a range of the angle $\theta_1$ and downward or clockwise in the range of angle $\theta_1$ relative to a tangent 271-1T to the arc 271E at the center point 271-1*c*. Further, a portion tilted upward at the angle $\theta_1$ relative to the tangent 271-1T is indicated by reference sign 271-1A ($\alpha_1=0°$), while a portion tilted downward at the angle $\theta_1$ relative to the tangent 271-1T is indicated by reference sign 271-1B ($\alpha_1=2\theta_1$). As illustrated in FIG. 7B, the portion 271-1A ($\alpha_1=0°$) and the portion 271-1B ($\alpha_1=2\theta_1$) are considered to be in a line symmetry or mirror with respect to the tangent 271-IT. Desirably, the portion 271-1 is disposed along the arc 271E in the extending direction thereof. Here, $\alpha_1<90°$ is desired. As will be described subsequently herein, the possession of this configuration allows the ridge part 271 to move smoothly without getting caught on the upper-electrode supporting portion 330 when the hammer-side loading part 210 has pivoted. As a consequence, a stable sound generating operation is feasible.

The above description has been made about the example in which the center point 520*c* of the pivot 520 overlaps with the center 271EC, but the location of the center point 520*c* is not limited to the above-described example. The center point 520*c* of the pivot 520 may be disposed more distant from the arc 271E than the center 271EC, or may be disposed closer to the arc 271E than the center 271EC.

Figure 8:
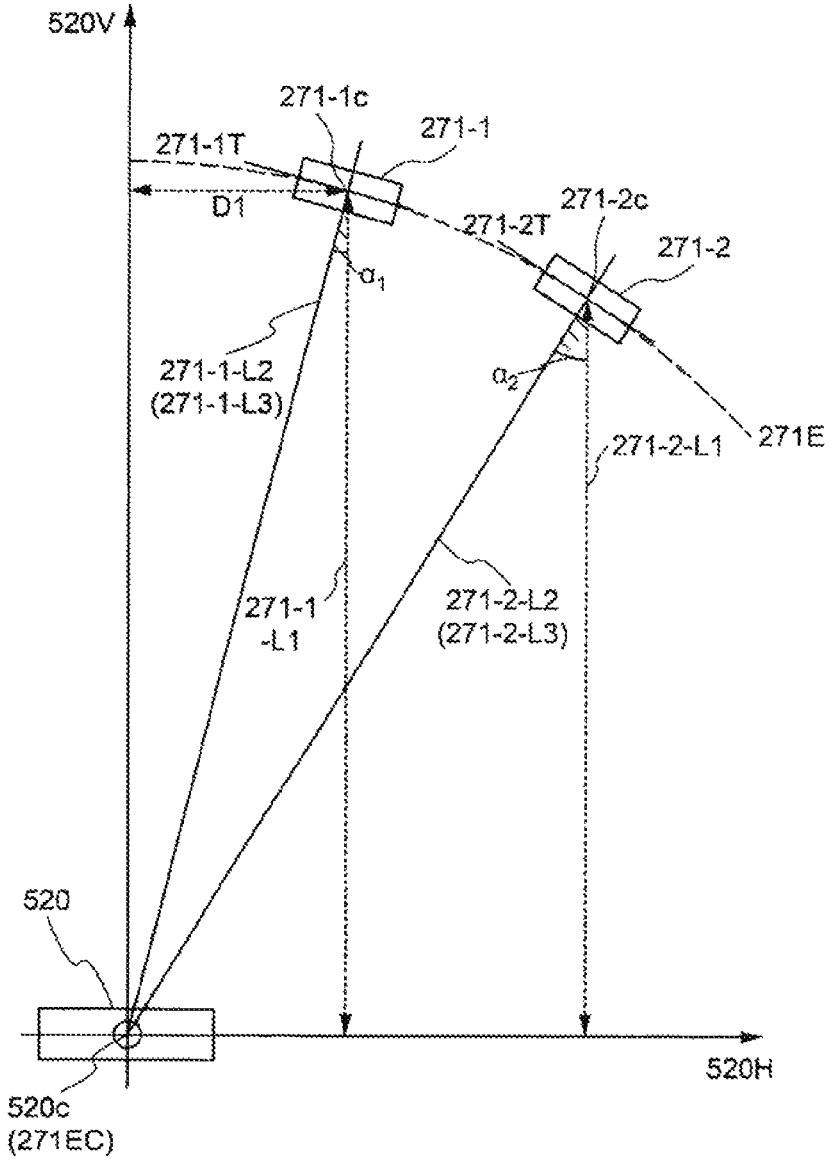
FIG. 8 is an explanatory view of the portion and another portion of the ridge part in the hammer-side loading part in the first embodiment of this disclosure as viewed from the lower surface of the key.

FIG. 8 is a more specific schematic view illustrating, in addition to the portion 271-1 as the first portion, a portion 271-2 as another portion, as an example of a second portion, in the ridge part 271. In FIG. 8, there are three lines having the center point 271-2*c* as a start point, that is, a line 271-2-L1, a line 271-2-L2 and a line 271-2-L3. The line 271-2-L1 is the line that is vertical to the line 520H, passes through the center point 271-2*c*, and extends toward the line 520H. The line 271-2-L2 is the line that is vertical to an extending direction of the portion 271-2, and extends toward the line 520H or the line 520V. As illustrated in this example, the line 271-2-L2 may be the same as the line, that is, line 271-2-L3 that connects the center point 520*c* of the pivot 520 and the center point 271-2*c* of the portion 271-2 together. With respect to the portion 271-1, the line 271-1-L2 and the line 271-1-L3 may also be the same. In this case, the portion 271-1 and portion 271-2 are portions of the arc centering on the center point 520*c* of the pivot 520, and the ridge part 271 is considered to include the arc.

As also illustrated in FIG. 8, the line 271-2-L1 and the line 271-2-L2 form an angle $\alpha_2$ that may be greater than the angle $\alpha_1$ formed between the line 271-1-L1 and the line 271-1-L2 at the enter point 271-1*c* of the portion 271-1. In this case, the line 271-2-L1 of the portion 271-2 has a length that may be shorter than that of the line 271-1-L1 of the portion 271-1.

Figure 9:
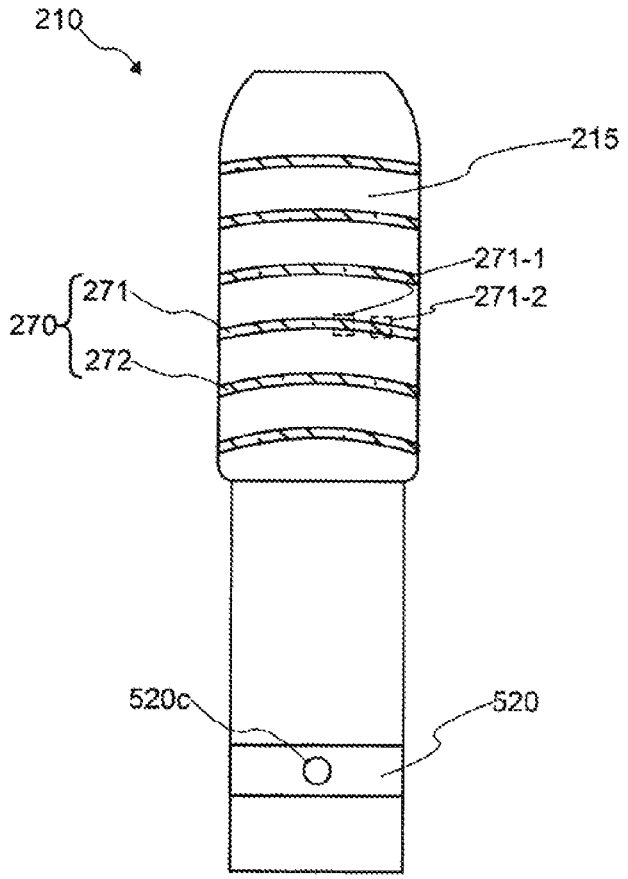
FIG. 9 is an explanatory view of a ridged surface in the hammer-side loading part in the first embodiment of this disclosure as viewed from the lower surface of the key.

FIG. 9 illustrates a plan view in a case where the ridged surface 215 of the hammer-side loading part 210 is viewed at an entirety thereof from the side of the upper-electrode supporting portion 330, that is, in the direction D3. The ridge parts 270 are disposed in arc shapes of concentric circles with respect to the center point 520*c* of the pivot 520. Among the ridge parts 270, the ridge part 272 is disposed closer to the pivot 520 than the ridge part 271. The ridge part 272 may have a radius of curvature smaller than that of the ridge part 271.

1-5. Operations of Keyboard Assembly

Figure 10A:
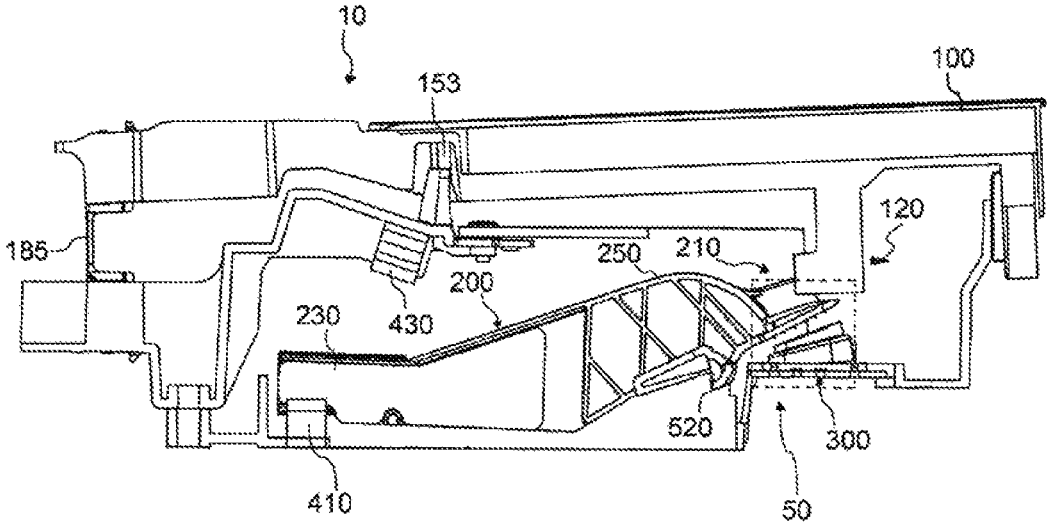
FIGS. 10A and 10B are views for explaining operations of a key assembly when a key or white key is depressed in the first embodiment of this disclosure.
Figure 10B:
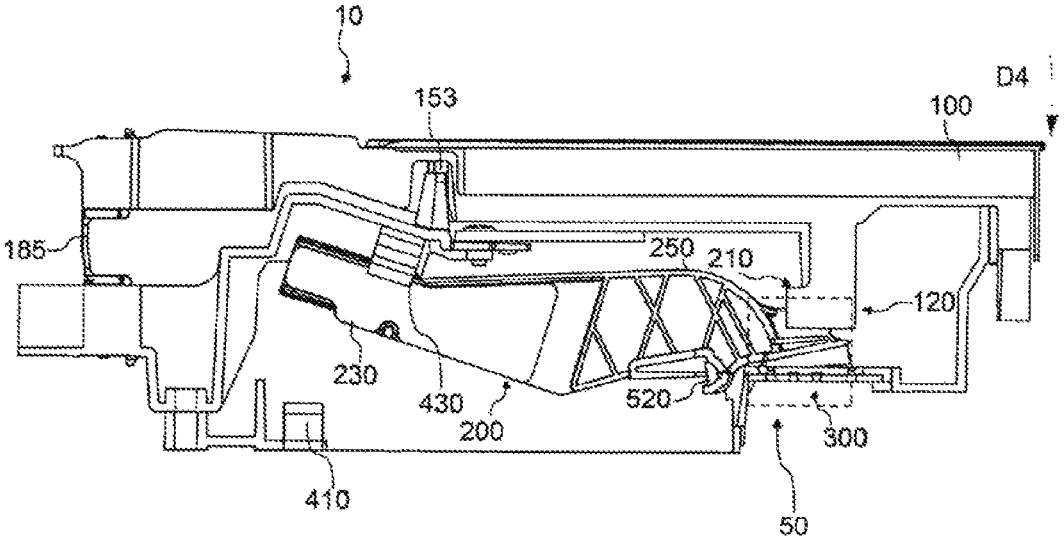

FIGS. 10A and 10B are views for explaining operations of a key assembly when a key or white key is depressed in this first embodiment. In FIG. 10A, the key 100 is at its rest position, that is, in a state of being not depressed. In FIG. 10B, on the other hand, the key 100 is at its end position, that is, in a state of having been depressed to the very end. When the key 100 is depressed, the channel-bar-shaped flexible member 185 is bent as a pivot center. At this time, the channel-bar-shaped flexible member 185 has undergone bending deformation toward a front side of the key 100, that is, in a front direction, but under a restriction on a movement in the front-and-back direction by the side-wall key guide 153, the key 100 does not move toward the front side but is induced to pivot in a direction vertical to the key 100, that is, in a direction D4. The key-side loading part 120 then depresses the hammer-side depressing part 210, whereby the hammer assembly 200 pivots about the pivot 520.

Then, the weight portion 230 strikes the upper stopper 430, whereby the pivotal motion of the hammer assembly 200 stops and the key 100 reaches the end position. When the sensor 300 is pressed and deformed by the hammer-side loading part 210, the sensor 300 outputs detection signals at a plurality of stages according to pressed and deformed amounts or depression strokes. In this case, the hammer-side loading part 210 functions as an actuator. The term "actuator" in this case means one that operates based on a key depression, presses the movable member by the operation, and actuates the sensor. A cross-sectional view of the pressing device 50 as viewed from the direction of the front end of key at this time is illustrated in FIG. 11.

Figure 11:
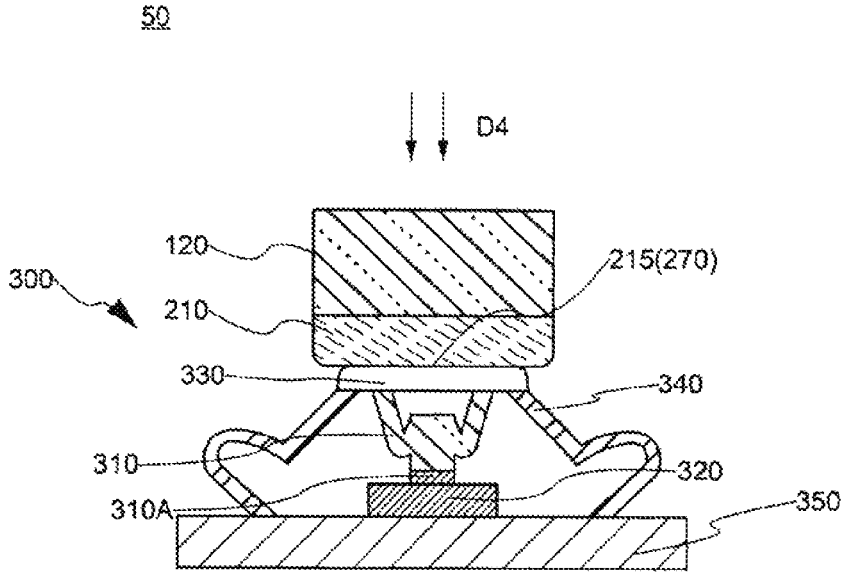
FIG. 11 is an explanatory view of the pressing device in the first embodiment of this disclosure.

As illustrated in FIG. 11, in a case where the upper-electrode supporting portion 330 is depressed by the hammer-side loading part 210 in a direction vertical to the lower-electrode supporting portion 350 or in the direction D4, in the sensor 300, the upper electrodes 310 and the lower electrode 320 come into contact with each other. Here, at the pressing device 50, a detection signal is normally outputted so that a stable sound is generated. However, a key located at a position distant from the player may be depressed or vibrations or off-centering may occur at the hammer assembly 200. Further, a slight clearance, that is, backlash may exist between the hammer assembly 200 and the frame 500 to which the hammer assembly 200 is secured. In these cases, the hammer-side loading part 210 as a tip part of the hammer assembly 200 may move in a direction different from a direction in which the hammer-side loading part 210 is supposed to pivot about the pivot 520 as a fulcrum in a normal situation, that is, in the direction in which the keys are aligned, for example, such as the scale direction, or the hammer-side loading part 210 may pivot in a plane of contact with the upper-electrode supporting portion 330.

Figure 14:
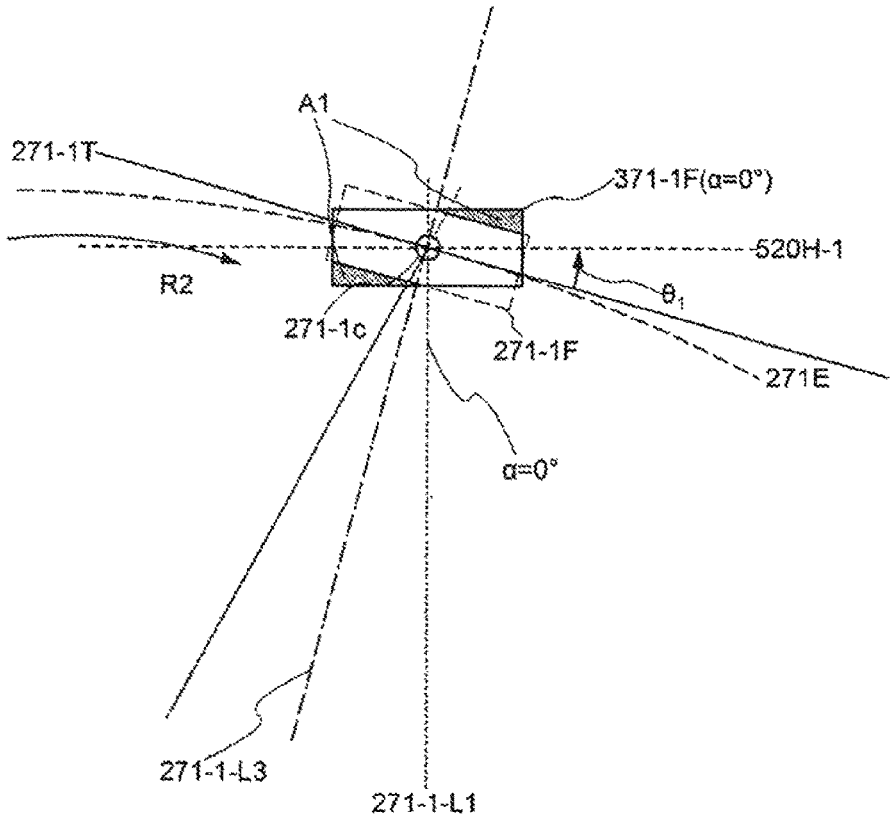
FIG. 14 is an explanatory view of a portion of a ridge part in a hammer-side loading part of a pressing device in a past example.
Figure 15:
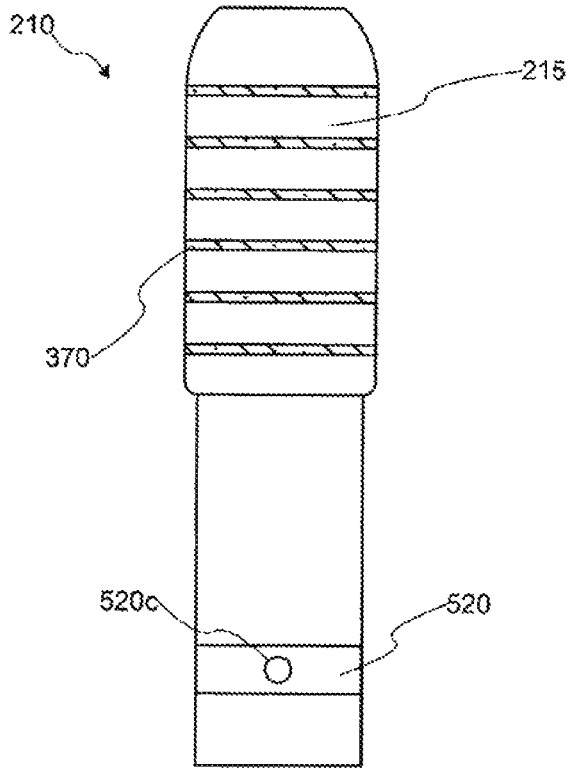
FIG. 15 is an explanatory view of a ridged surface in the hammer-side loading part in the past example.

Here, a description will be made about effects by a positional difference in the arrangement of the portion 271-1 as the portion of the ridge part 271. FIG. 14 is a schematic diagram in a case where the arrangement of the portion 271-1 has been changed. FIG. 14 illustrates a case in which the angle $\alpha_1$ at the portion 271-1 has been changed to 0°, specifically a case in which the portion 271-1F has tilted upward or counterclockwise at the angle $\theta_1$ relative to the tangent 271-1 and has become the portion 371-1F which is parallel to the line 520H. More specifically, as illustrated in FIG. 15, the ridge parts 370 are disposed in parallel to the longitudinal direction of the pivot 520.

Figure 16:
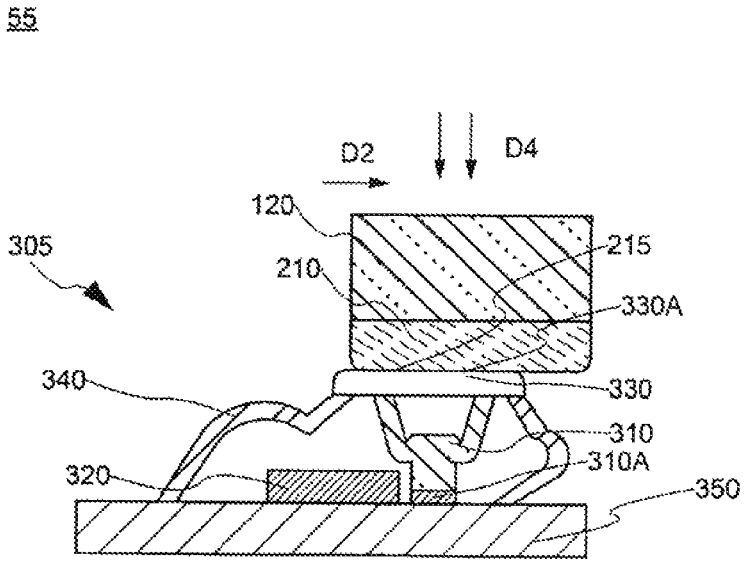
FIG. 16 is an explanatory view of the pressing device in the past example.

In the above-described case, the hammer-side loading part 210 pivots, centering about the center point 520*c* of the pivot 520, in a plane in which the ridge parts 270 of the hammer-side loading part 210 and the upper-electrode supporting portion 330 come into contact with each other. At this time, the portion 371-1F in the hammer-side loading part 210 may dig into the upper-electrode supporting portion 330 formed from a soft material such as silicone rubber. In another case, when the hammer-side loading part 210 pivots in a horizontal direction or a direction R2, friction may occur between the portion 371-1F and the upper-electrode supporting portion 330. In these cases, there is a potential problem of catching of the portion 371-1F at areas A1. Accordingly, as illustrated in FIG. 16, the upper-electrode supporting portion 330 follows the movement of the hammer-side loading part 210 in the pressing device 55 so that the upper electrodes 310 may not establish any electrical contact with the lower electrode 320. If no electrical contact is established between the upper electrodes 310 and the lower electrode 320, a sensor 305 may not output any detection signal so that the keyboard instrument 1 may not generate any sound. Even if the upper electrodes 310 and the lower electrode 320 are connected in parts to each other, no stable connection is established so that the keyboard instrument 1 may not stably generate a sound.

Figure 17:
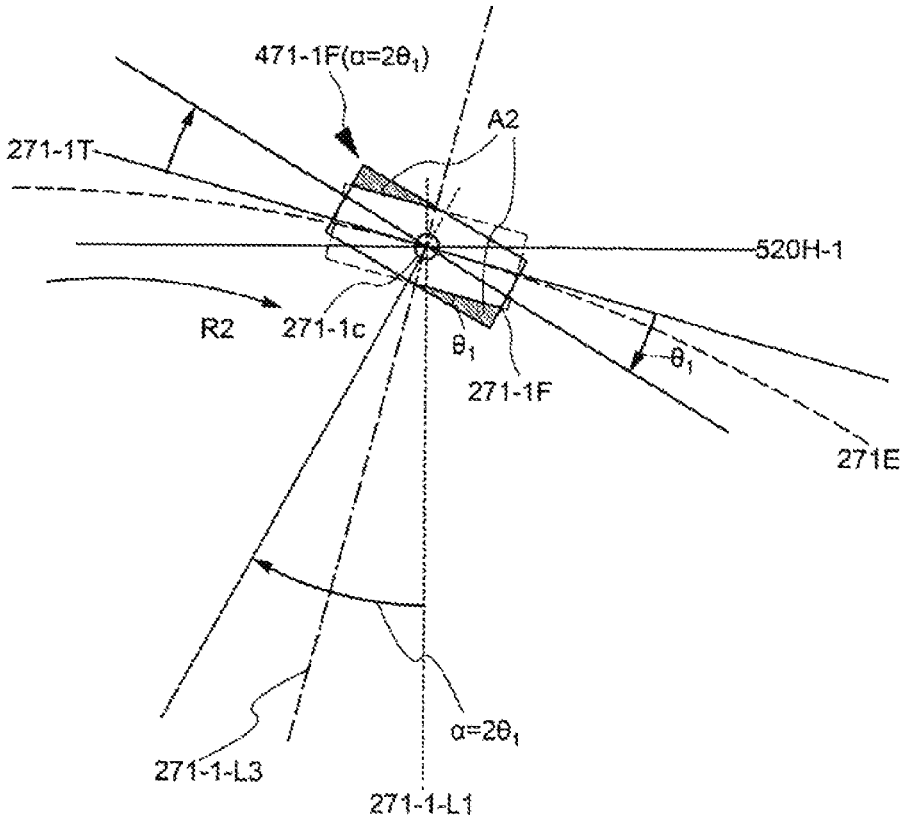
FIG. 17 is an explanatory view of the portion of the ridge part in the hammer-side loading part of the pressing device in the past example.

FIG. 17 illustrates a case in which the angle $\alpha_1$ at the portion 271-1 has been set at $2\theta_1$ or greater, specifically a case in which the portion 271-1F has tilted downward or clockwise at the angle $\theta_1$ or greater relative to the tangent 271-1T and has become a portion 471-1F. In this case, the portion 471-1F, similar to the case of the portion 371-1F, may dig into the upper-electrode supporting portion 330 or may cause friction with the upper-electrode supporting portion 330 when the hammer-side loading part 210 pivots in the horizontal direction or the direction R2. In these cases, the portion 471-1F may be caught at areas A2 thereof. As a consequence, the upper-electrode supporting portion 330 may follow the movement of the hammer-side loading part 210 so that the upper electrodes 310 may not establish any electrical contact or any stable contact with the lower electrode 320. Therefore, the keyboard instrument 1 may not stably generate a sound.

Figure 12:
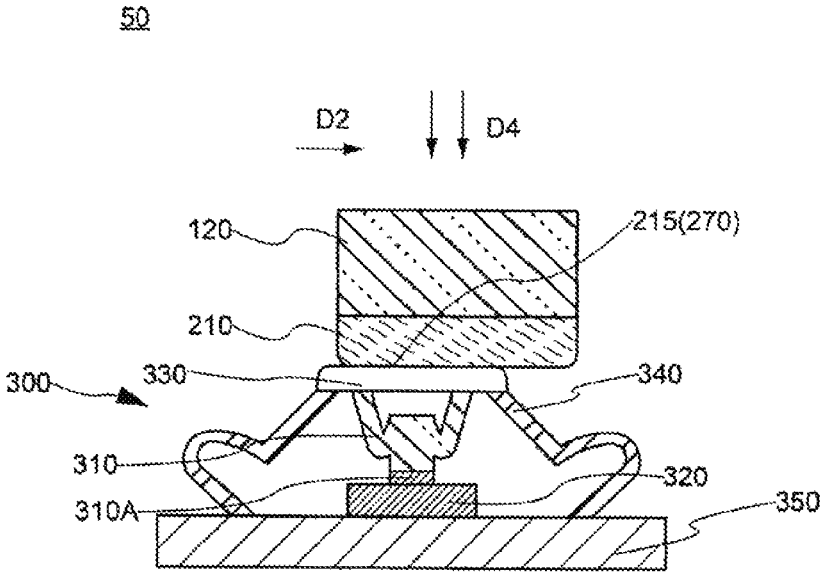
FIG. 12 is another explanatory view of the pressing device in the first embodiment of this disclosure.

In the case of this embodiment, on the other hand, there is the relationship of $0<\alpha_1<2\theta_1$ at the portion 271-1 so that, when the hammer assembly 200 including the hammer-side loading portion 210 pivots, the portion 271-1 is prevented or reduced from being caught on the upper-electrode supporting portion 330. As a consequence, the upper-electrode supporting portion 330 is suppressed from following the movement of the hammer-side loading part 210. As illustrated in FIG. 12, the upper electrodes 310 and the lower electrode 320 are hence ensured to come into contact with each other when the upper-electrode supporting part 330 is depressed by the hammer-side loading part 210. Therefore, the keyboard instrument 1 may stably generate a sound. In addition, the deformable portions 340 stably functions in the above-described operations, and therefore the sensor 300 is prevented from being applied with a localized force, which may also be called "a biased load," and is improved in durability.

Second Embodiment

2. Configuration of Pressing Device 50-1

As to the second embodiment, a description will be made about a pressing device 50-1 having a different structure from the pressing device 50 in the first embodiment. Concerning the same configurations as in the first embodiment, their descriptions apply equally.

Figure 13:
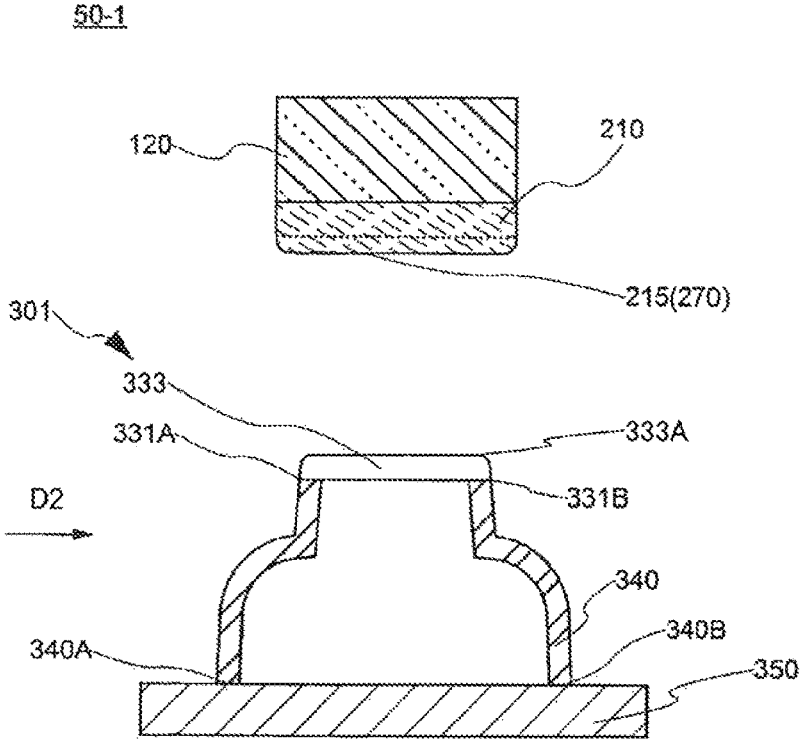
FIG. 13 is an explanatory view of a pressing device in a second embodiment of this disclosure as viewed from a front end side of a key.

FIG. 13 is a cross-sectional view of the pressing device 50-1 as viewed from a key-front-end side. In the pressing device 50-1, a hammer-side loading part 210 and a reaction-force generating member 301 have similar configurations as the corresponding ones in the sensor 300 except for the omission of the upper electrodes 310 and the lower electrode 320. In a case where no electrodes are arranged in a pressing device as mentioned above, the pressing device may be called "a reaction-force generating device." Owing to the inclusion of the above-mentioned configurations, the hammer-side loading part 210 and reaction-force generating member 301 forms a plurality of tangent planes 333 which are in contact with upper end surfaces 331A and 331B of the deformable portions 340. Each tangent plane 333 comes at an upper surface 333A thereof into contact with the corresponding two ridge parts 270. Further, a pivotal fulcrum is included in each tangent plane 333. Upon depression of the reaction-force generating member 301 by the hammer-side loading part 210 that functions as an actuator, no force component is generated in a longitudinal direction of the key 100, that is, in a direction in which shear stress acts, or the generation of such a force component is suppressed. Hence, the hammer-side loading part 210 typically moves with an orientation vertical, that is, in a normal direction relative to the tangent plane 333 while pivoting. As a consequence, the reaction-force generating member 301 may generate a reaction force at an appropriate timing so that an improved touch feeling is available from the keyboard instrument. In addition, the reaction-force generating member 301 is prevented from abnormal deformation in the pressing device 50-1, and therefore the pressing device 50-1 is improved in durability.

<Modifications>

The first and second embodiments of this disclosure have been described above, but this disclosure may be practiced in various modes as will be described hereinafter.

In the first and second embodiments of this disclosure, the ridge parts 270 are exemplified to have an arc shape, but are not limited to such a shape. The ridge parts 270 may be parallel to the direction, in which the pivot 520 extends, instead of having such a partial arc shape. Further, no limitations are imposed on the number and dimensions of the ridge parts 270. The ridge parts 270 may have smaller dimensions than those illustrated in FIG. 9, and more ridge parts may be disposed than the number of the ridge parts 270 illustrated in FIG. 9.

At the portion 271-1, the angle $\alpha_1$ and angle $\theta_1$ are exemplified to satisfy $0<\alpha_1<2\theta_1$ and desirably $\alpha_1<90°$, but are not limited to such a relationship or relationships. The portion 271-1 may have a portion or portions satisfying $0<\alpha_1<2\theta_1$ and the angle $\alpha_1>90°$.

In the first and second embodiments of this disclosure, the hammer-side loading part 210 is exemplified to come into contact with the upper-electrode supporting portion 330. However, the key-side loading part 120 may come into direct contact with the upper-electrode supporting portion 330 to directly depress the upper-electrode supporting portion 330. In this case, the sensor 300 is disposed at a location different from the location illustrated in FIG. 3, and is disposed immediately underneath the key 100, that is, at an intermediate location on a line that connects the front-end key guide 151 and the side-wall key guide 153 together in FIG. 3, for example. In this configuration, the key 100 comes into contact with the hammer assembly 200 at a location different from the location illustrated in FIG. 3. The key-side loading part 120 is directly exposed to effects of a key depression by the player, so that the upper-electrode supporting portion 330 becomes more susceptible of moving in the scale direction. Therefore, the effects available from the use of this disclosure may be brought about still more abundantly.

In addition, the hammer-side loading part 210 and key-side loading portion 120 may not depress the upper-electrode supporting portion 330. For example, another member discrete from the hammer-side loading part 210 or the key-side loading part 120 may function as an actuator. In this case, the actuator may be an interlock member that is interlocked with a key or a hammer. Examples of the interlock member include a pivotal member, such as a lever, disposed between the key and the hammer.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2017-060171 filed in the Japan Patent Office on Mar. 24, 2017 and PCT/JP2018/010264 filed on Mar. 15, 2018, the entire contents of which are hereby incorporated by reference.

What is claimed is:

1. An actuator, comprising:

a pivot; and a ridged surface on which a ridge part is formed and disposed, wherein in a plan view of the ridged surface, the ridge part has a first portion configured to satisfy a relationship of $0<\alpha_1<2\theta_1$, where $\alpha_1$ is an angle formed between a first line and a second line, the first line is vertical to a parallel line that passes through a center point of the pivot, the first line is parallel to a direction in which the pivot extends, the first line passes through a center point of the first portion, the second line is vertical, at the center point of the first portion, to a direction in which the first portion extends, the second line passes through the center point of the first portion, and where θ1 is an angle formed between the first line and a third line which connects the center point of the pivot and the center point of the first portion.

2. The actuator according to claim 1, wherein the angle $\alpha_1$ is smaller than 90°.

3. The actuator according to claim 1, wherein the ridge part further has a second portion, the second portion is configured to satisfy a relationship of $\alpha_1<\alpha_2$, where $\alpha_2$ is an angle formed between a fourth line and a fifth line, the fourth line is vertical to the parallel line, passes through a center point of the second portion, the fourth line extends from the center point of the second portion toward the parallel line, the fifth line which is vertical to a direction in the second portion extends, and the fifth line passes through the center point of the second portion and extends toward the parallel line or a vertical line vertical to the direction in which pivot extends.

4. The actuator according to claim 1, wherein the ridge part is disposed in an arc shape with respect to the center point of the pivot.

5. The actuator according to claim 4, wherein at least one additional ridge part is formed on the ridged surface so that a plurality of ridge parts is arranged on the ridged surface, a first ridge part which is one of the plurality of ridge parts is disposed closer to the pivot than a second ridge part of the plurality of ridge parts, and the first ridge part has a radius of curvature smaller than that of the second ridge part.

6. A pressing device, comprising:

the actuator according to claim 1 and a movable member to be pressed by the actuator, wherein an elastic material is used in the movable member.

7. The pressing device according to claim 6, further includes a reaction-force generating device.

8. The pressing device according to claim 6, further includes a switching device.

9. A keyboard instrument, comprising:

the pressing device according to claim 6, wherein the actuator includes a hammer.

10. A keyboard instrument, comprising:

the pressing device according to claim 6, wherein the actuator includes a key.

11. A keyboard instrument, comprising:

the pressing device according to claim 6, wherein the actuator includes an interlock member that is interlocked with a key or a hammer.

* * * * *